US006539652B1

(12) United States Patent
Barry

(10) Patent No.: US 6,539,652 B1
(45) Date of Patent: Apr. 1, 2003

(54) METHOD OF A NEW HAND IRON TRANSFER TECHNIQUE

(75) Inventor: Claudia Barry, Hawley, PA (US)

(73) Assignee: Foto-Wear, Inc., Milford, PA (US)

( * ) Notice: Subject to any disclaimer, the term of this patent is extended or adjusted under 35 U.S.C. 154(b) by 0 days.

(21) Appl. No.: 09/453,881

(22) Filed: Feb. 14, 2000

Related U.S. Application Data

(60) Provisional application No. 60/178,768, filed on Jan. 28, 2000.

(51) Int. Cl.[7] ..... D06F 77/00; B44C 1/165

(52) U.S. Cl. ..... 38/144; 156/230

(58) Field of Search ..... 38/144, 10, 75, 38/7, 2; 156/230, 235, 240; 428/29, 202, 914

(56) References Cited

U.S. PATENT DOCUMENTS 2,810,219 A * 10/1957 Craig ..... 38/144
3,985,602 A * 10/1976 Stuart
4,964,230 A * 10/1990 Mai ..... 38/30
5,133,819 A * 7/1992 Croner
5,252,171 A * 10/1993 Anderson et al. ..... 38/16
5,620,548 A * 4/1997 Hare
5,938,879 A 8/1999 Brown
6,143,115 A * 11/2000 Sammis

FOREIGN PATENT DOCUMENTS

WO 9733763 9/1997
WO 9926111 5/1999

OTHER PUBLICATIONS

Hewlett–Packard Iron on t–shirt transfer instructions, 1999.
Avery t–shirt transfer sheet instructions.
Hammermill Papers iron on transfer instructions, May 1998.
Kodak transfer instructions.
Epson transfer instructions, 1997.
Copy trans transfer instructions.
Canon transfer TR–201 instructions.

* cited by examiner

*Primary Examiner*—Ismael Izaguirre
(74) *Attorney, Agent, or Firm*—Birch, Stewart, Kolasch & Birch, LLP

(57) ABSTRACT

A process is provided for transferring an image from an imaged transfer sheet onto a receptor using a hand iron. The process provides for an improved transfer performance.

29 Claims, 4 Drawing Sheets

2A

2B

2C

2D

METHOD OF A NEW HAND IRON TRANSFER TECHNIQUE

CROSS-REFERENCE TO RELATED APPLICATIONS

Referenced-Applications

The contents of Provisional Application U.S. Ser. No. 60/178,768 filed Jan. 28, 2000, on which the present application is based and benefit claimed under 35 USC §119 (e), is herein incorporated by reference.

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

The present invention relates to a process for transferring an image from a transfer sheet onto a receptor using a hand iron. The process provides for an improved transfer performance.

2. Description of the Prior Art

Textiles such as shirts (e.g., tee shirts) having a variety of designs thereon have become very popular in recent years. These designs may be transferred to a fabric or textile using a professional or commercial transfer apparatus, such as a commercial heat press. Alternatively, the consumer can separately purchase the fabric and pre-imaged transfer sheets or transfer sheets to be imaged by the consumer, decorate (e.g. image) the transfer sheet at home, and transfer the image to the fabric by using a hand iron.

Imaged transfer sheets which are to be applied onto fabrics are known in the art. The support for the transfer is of conventional design and well-known to those skilled in the art. The image includes indicia from simple one-color block letters to elaborate multi-color illustrations. The transfer sheets also come in various sizes, and suitable transfer layers are known in the art.

To apply an image from a transfer sheet to a receptor (e.g. fabric), a heated iron or press is typically used. The transfer sheet containing the image to be transferred is placed on the receptor (e.g. T-shirt) such that the imaged side of the transfer sheet is in contact with the receptor. Heat is then applied to the transfer sheet on the side opposite of the imaged side (e.g. backside), allowing the transfer layer to melt, thereby releasing the image and transfer material from the transfer sheet, and to flow onto the receptor. The support of the transfer sheet is removed from the receptor leaving behind the transfer layer and image.

A variety of transfer processes have been described in the prior art and in commercially available products. For example, U.S. Pat. No. 3,985,602 to Stuart describes processes for transferring images from a paper sheet to another sheet which may, for instance be a fabric. The Stuart patent describes a composite sheet which incorporates a paper carrier sheet with a transparent, thermoplastic sheet, and having an image retaining, pressure sensitive adhesive layer. The composite sheet is placed against a printed image on paper, and the pressure sensitive adhesive holds the image while the original paper backing is dissolved away by water. A source of heat, such as an iron, is used to cause a melting of the thermoplastic layer whereby the plastic, with the adhesive and the image are bonded to a fabric such as a shirt. Then, the paper carrier is removed.

In U.S. Pat. No. 5,133,819 to Croner, a process for reproducing a source image on a fabric is described. In this process, a transfer fabric containing the image to be transferred is placed on a receiving fabric so that a heat-activated adhesive on the image is in contact with the receiving fabric. The transfer fabric and adhesive are then heated so that the image is transferred to the receiving fabric.

Many image-transfer kits which are commercially available to the consumer include a transfer sheet and instructions for printing and transferring the design onto the desired article of clothing. For example, Canon™ includes instructions for "T-Shirt Transfers TR-201" which direct the consumer to transfer a small design to a T-shirt by ironing around the edges of the design, and then ironing over the entire design for approximately 20 seconds. When larger designs are being transferred, the consumer is instructed to iron from top to bottom for 10 to 15 seconds, repeating the process six to eight times, then iron from side to side for four to six repetitions of 15 to 20 seconds each. Finally, the consumer should iron around the edge of the transfer sheet for 30 to 40 seconds. The transfer sheet and T-shirt are cooled for one to two minutes before removing the transfer sheet.

A similar set of instructions for a Hewlett-Packard® T-shirt transfer kit directs the consumer to iron from side to side for one minute at one edge of the transfer sheet, and repeat the process at the opposite edge. This is followed by ironing in large circles around the entire sheet for one minute. The printed transfer is cooled for at least five minutes before the transfer sheet is removed.

Epson® sells iron-on transfers with instructions to first iron over the long side of the transfer sheet, then iron over the opposite side two times, followed by ironing in a circular motion over the entire sheet. The total ironing process should take at least two to three minutes. The transfer sheet is peeled off while hot.

An image transfer kit sold by Kodak™ uses an ironing process wherein the consumer irons for 30 seconds per area in the following order: from the upper left to the upper right, from the lower left to the lower right, from the upper left to the upper right, from the lower left to the lower right, then three times circularly along the outer edges. The printed transfer is cooled for one minute before removing the transfer sheet.

In a separate image transfer kit sold by Kodak™, the consumer irons for 30 seconds per area in the following order: from upper left to upper right, from middle left to middle right, from lower left to lower right, from upper left to upper right, from middle left to middle right, from lower left to lower right, circularly over the outer edges, then over the entire transfer.

Avery® sells a T-shirt transfer kit with instructions which direct the consumer to iron one area of the transfer sheet, pressing for 10 to 20 seconds per area until the entire transfer sheet has been heated. This is followed with a circular ironing step which covers the transfer sheet. The printed transfer is cooled completely before the transfer sheet is removed.

Hammermill Papers™ sells cool-peel iron-on transfers, marketed under the name Invent it! ™. The instructions for transferring an image include ironing from lower left to upper left for 15 seconds, ironing from lower right to upper right for 15 seconds, then ironing in circles, at two to three seconds per circle, for two minutes. The printed transfer is cooled completely.

Copy Trans Ink Jet™ sells transfers for T-shirts which are transferred by ironing over the entire transfer for 15 to 20 seconds per position, followed by ironing in a circular motion. The transfer sheet is removed while hot.

The disadvantage of all of these methods is that the transferred image is often not completely transferred to the fabric, leaving portions of the design on the transfer sheet upon removal. The present invention provides an improved ironing technique resulting in improved transfer and washability of the imaged receptor element and a clearer transferred image with less cracking.

SUMMARY OF THE INVENTION

The present invention provides, in one embodiment, Method A which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, across the top edge of the transfer sheet, towards the opposite top side edge of the transfer sheet, completing the pass in about 15 sec.–2 min.; (d) repeating the pass of step (c) at least three additional times while moving the first starting position of the iron towards the bottom side edge of the transfer sheet with each repetition, wherein each subsequent pass overlaps the path of the previous pass; (e) applying the iron to the back non-imaged surface of the transfer sheet at a second starting position at a bottom side edge of the transfer sheet; (f) moving the iron in one pass in a path from said bottom side edge of the transfer sheet, and up along the side edge of the transfer sheet, towards the top side edge of the transfer sheet, completing the pass in about 15 sec.–2 min.; and (g) repeating the pass of step (f) at least four additional times while moving the second starting position of the iron towards the opposite bottom side edge of the transfer sheet with each repetition, wherein each subsequent pass overlaps the path of the previous pass.

In another embodiment of the present, there is provided Method B which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, across the bottom edge of the transfer sheet, towards the opposite bottom side edge of the transfer sheet, completing the pass in about 15 sec.–2 min.; (d) repeating the pass of step (c) at least two additional times while moving the first starting position of the iron towards the top side edge of the transfer sheet with each repetition, wherein each subsequent pass overlaps the path of the previous pass; (e) applying the iron to the back non-imaged surface of the transfer sheet at a second starting position at a bottom side edge of the transfer sheet; (f) moving the iron in one pass from said bottom side edge of the transfer sheet, up along the side edge of the transfer sheet, towards the top side edge of the transfer sheet, completing the pass in about 15 sec.–2 min.; (g) repeating the pass of step (f) at least two additional times while moving the second starting position of the iron towards the opposite bottom side edge of the transfer sheet with each repetition, wherein each subsequent pass overlaps the path of the previous pass; (h) repeating steps (b) through (d); and (i) repeating steps (e) through (g).

In another embodiment of the invention, there is provided Method C which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, across the bottom edge of the transfer sheet, towards the opposite bottom side edge of the transfer sheet, completing the pass in about 15 sec.–2 min.; (d) repeating the pass of step (c) at least three additional times while moving the first starting position of the iron towards the top side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass in a path from said top side edge of the transfer sheet, and down along the side edge of the transfer sheet, towards the bottom side edge of the transfer sheet, completing the pass in about 15 sec.–2 min.; and (g) repeating the pass of step (f) at least four additional times while moving the second starting position of the iron towards the opposite top side edge of the transfer sheet with each repetition, wherein each subsequent pass overlaps the path of the previous pass.

In another embodiment of the invention, there is provided Method D which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, across the top edge of the transfer sheet, towards the opposite top side edge of the transfer sheet, completing the pass in about 15 sec.–2 min.; (d) repeating the pass of step (c) at least two additional times while moving the first starting position of the iron towards the bottom side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass from said top side edge of the transfer sheet, down along the side edge of the transfer sheet, towards the bottom side edge of the transfer sheet, completing the pass in about 15 sec.–2 min.; (g) repeating the pass of step (f) at least two additional times while moving the second starting position of the iron towards the opposite top side edge of the transfer sheet with each repetition, wherein each subsequent pass overlaps the path of the previous pass; (h) repeating steps (b) through (d); and (i) repeating steps (e) through (g).

In another embodiment of the invention, there is provided Method E which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, and up along the side edge of the transfer sheet, towards the top side edge of the transfer sheet, completing the pass in about 15 sec.–2 min.; (d) repeating the pass of step (c) at least four additional times while moving the first starting position of the iron towards the opposite bottom side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass in a path from said top side edge of the transfer sheet, across the top edge of the transfer sheet, towards the opposite top side edge of the transfer sheet, completing the pass in about 15 sec.–2 min.; and (g) repeating the pass of step (f) at least three additional times while moving the second starting position of the iron towards the bottom side edge of the transfer sheet with each repetition, wherein each subsequent pass overlaps the path of the previous pass.

In another embodiment of the present, there is provided Method F which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, up along the side edge of the transfer sheet, towards the top side edge of the transfer sheet, completing the pass in about 15 sec.–2 min.; (d) repeating the pass of step (c) at least two additional times while moving the first starting position of the iron towards the opposite bottom side edge of the transfer sheet with each repetition, wherein each subsequent pass overlaps the path of the previous pass; (e) applying the iron to the back non-imaged surface of the transfer sheet at a second starting position at a bottom side edge of the transfer sheet; (f) moving the iron in one pass from said bottom side edge of the transfer sheet, across the bottom edge of the transfer sheet, towards the opposite bottom side edge of the transfer sheet, completing the pass in about 15 sec.–2 min.; (g) repeating the pass of step (f) at least two additional times while moving the second starting position of the iron towards the top side edge of the transfer sheet with each repetition, wherein each subsequent pass overlaps the path of the previous pass; (h) repeating steps (b) through (d); and (i) repeating steps (e) through (g).

In another embodiment of the invention, there is provided Method G which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, and down along the side edge of the transfer sheet, towards the bottom side edge of the transfer sheet, completing the pass in about 15 sec.–2 min.; (d) repeating the pass of step (c) at least four additional times while moving the first starting position of the iron towards the opposite top side edge of the transfer sheet with each repetition, wherein each subsequent pass overlaps the path of the previous pass; (e) applying the iron to the back non-imaged surface of the transfer sheet at a second starting position at a bottom side edge of the transfer sheet; (f) moving the iron in one pass in a path from said bottom side edge of the transfer sheet, across the bottom edge of the transfer sheet, towards the opposite bottom side edge of the transfer sheet, completing the pass in about 15 sec.–2 min.; and (g) repeating the pass of step (f) at least three additional times while moving the second starting position of the iron towards the top side edge of the transfer sheet with each repetition, wherein each subsequent pass overlaps the path of the previous pass.

In another embodiment of the invention, there is provided Method H which is a method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, down along the side edge of the transfer sheet, towards the bottom side edge of the transfer sheet, completing the pass in about 15 sec.–2 min.; (d) repeating the pass of step (c) at least two additional times while moving the first starting position of the iron towards the opposite top side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass from said top side edge of the transfer sheet, across the top edge of the transfer sheet, towards the opposite top side edge of the transfer sheet, completing the pass in about 15 sec.–2 min.; (g) repeating the pass of step (f) at least two additional times while moving the second starting position of the iron towards the bottom side edge of the transfer sheet with each repetition, wherein each subsequent pass overlaps the path of the previous pass; (h) repeating steps (b) through (d); and (i) repeating steps (e) through (g).

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a diagram of the ironing method according Methods A and E of the invention.

FIG. 2A corresponds to steps (b)–(d) of Method B and steps (e)–(g) of Method F. FIG. 2B corresponds to steps (e)–(g) of Method B and steps (b)–(d) of Method F. FIG. 2C corresponds to step (h) of Method B and step (i) of Method F. FIG. 2D corresponds to step (i) of Method B and step (h) of Method F. The iron is moving in a direction substantially perpendicular to the longitudinal axis of the iron.

FIG. 3 is a diagram of the ironing method according Methods C and G of the invention.

FIG. 4A corresponds to steps (b)–(d) of Method D and steps (e)–(g) of Method H. FIG. 4B corresponds to steps (e)–(g) of Method D and steps (b)–(d) of Method H. FIG. 4C corresponds to step (h) of Method D and step (i) of Method H. FIG. 4D corresponds to step (i) of Method D and step (h) of Method H. The iron is moving in a direction substantially perpendicular to the longitudinal axis of the iron.

DETAILED DESCRIPTION OF THE INVENTION

1. Transfer Sheet

Figure 1A:
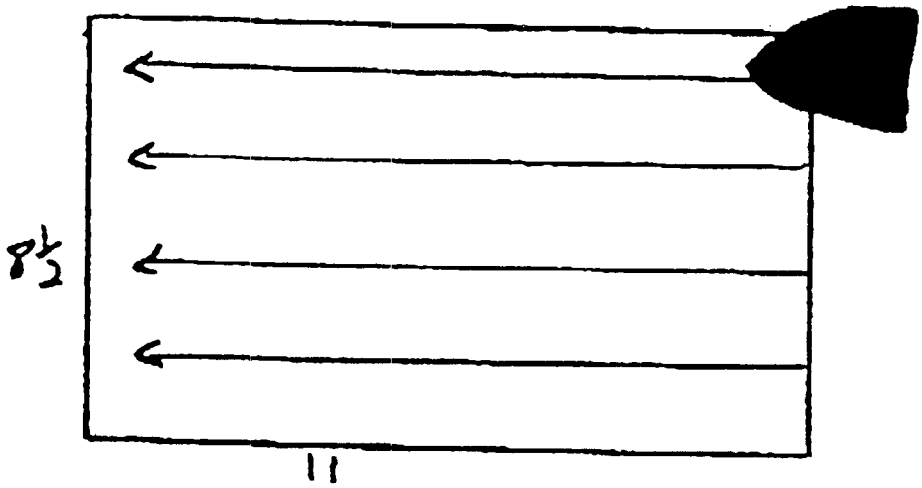
FIG. 1A corresponds to steps (b)–(d) of Method A, and to steps (e)–(g) of Method E.

Suitable transfer sheets include any heat-activated transfer sheet designed for use with a hand iron or heat press, including the sheets discussed in the description of the prior art. For example, the transfer sheets disclosed in U.S. provisional applications No. 60/157,018 filed Oct. 1, 1999, Ser. No. 60/127,625 filed Apr. 1, 1999 and Ser. No. 60/133,861 filed May 12, 1999 may be used with the present technique. Additionally, the transfer sheets disclosed in U.S. Pat. Nos. 4,773,953, 4,980,224, 5,271,990, 5,501,902, 5,242,739, 5,139,917, 5,236,801, 5,948,586 and 5,798,179, which are herein incorporated by reference, may be used in the present methods. A preferred transfer sheet is CopyFantasy® CTM50, manufactured by Messerli.

Accordingly, dry release transfer materials per se are well known in the art, and any suitable dry release transfer material may be used in the invention. Canon™ creative products T-Shirt Transfers TR-101 may be used. Other suitable transfer materials include a transfer sheet known as "TRANSEEZE" manufactured by Kimberly-Clark Corporation™ or any other commercially available transfer sheet which has a substrate with a coating which is transferable to a receptor sheet upon the application of heat or pressure to the back of the substrate, and may be coated with, for instance, Singapore Dammar Resin. Also, Cycolor™ transfer materials as disclosed U.S. Pat. Nos. 5,139,917 and 5,236,801 and application Ser. No. 09/970,424 may be used, or silver halide transfer materials as disclosed in U.S. Pat. No. 5,620,548 and co-pending applications U.S. Ser. Nos. 08/479,409 and 08/962,296 may be used.

If a transfer carrier layer is used in the transfer material, the transfer carrier layer is preferably capable of transfer from the support (e.g. imaging sheet) and adherence to a receptor without the requirement of a separate surface adhesive layer. Without being bound by any theory, upon back surface heating of the support, the carrier would undergo a solid to solution phase transition resulting in a transfer to the receiving layer. Edge to edge adhesion, to the receiving layer, would occur upon cooling of the carrier onto the receiving layer. Upon cooling, an image layer would be completely transferred onto the receiving layer with an excess of carrier providing mechanical and thermal stability, as well as washability. The transfer carrier layer of the transfer material should provide a colorfast image (e.g. washproof or wash resistant) when transferred to the receptor surface. That is, upon washing the receptor element (e.g. tee shirt), the image should remain intact on the receptor element.

The preferred size of the transfer sheet is either 8½×11 inches or A4 size paper (210×297 mm or 8.27×11.69 inches).

2. Receptor Element

Suitable receptor elements include any receptor element which is capable of receiving the image and transfer layer and withstanding the heat used in the ironing process. For example, textiles or fabrics such as cotton, polyester, and cotton/polyester blend fabrics may be used. Optionally, the fabric may be ironed prior to the transfer process in order to remove moisture and/or wrinkles from the fabric.

3. Method

In the process of the invention it is preferable that the hand iron be set at a temperature of at least 350° F., more preferably 375° F. Typically, the iron should be set at the maximum temperature setting. It is further preferred that the steam setting of the iron not be used. For best results, the receptor element to which the image is being transferred should be on a flat surface and should be smoothed to eliminate any wrinkles prior to the transfer process.

The imaged transfer sheet is placed image side down on the receptor element to be decorated. The user should iron slowly but firmly according to the present technique, and should ensure that the entire transfer sheet has been heated. While the iron is in contact with the transfer sheet, it is preferred that the iron be kept in constant motion. Once the ironing steps are complete, it is preferable that the transfer sheet be allowed to cool for approximately one minute before it is peeled away from the imaged receptor element. It is further preferred that the transfer sheet be allowed to cool completely before peeling the transfer sheet away from the imaged receptor element. Preferably, the transfer sheet is peeled away from the imaged receptor element starting with one corner and peeling the sheet diagonally towards the opposite comer until the entire transfer sheet has been removed.

Preferably, the iron is moved either substantially parallel or substantially perpendicular to the longitudinal axis of the iron. Conventional irons have a heating element shape which approximates an isosceles triangle. In such an iron, the longitudinal axis is the axis of symmetry which bisects the isosceles triangle into two identical right triangles.

The length of time for each pass over the transfer sheet is about 15 seconds to 2 minutes. Preferably 17 seconds to 2 minutes. More preferably 17 seconds to 1.5 minutes. More preferably 17–45 seconds, and a most preferred length of time is 20–25 seconds.

Each pass over the transfer sheet should overlap the path of the previous pass by an amount sufficient to ensure that all areas are heated. For example, the overlap may be four inches or less, preferably two inches or less, more preferably one inch or less.

EXAMPLES

The transfer technique of Method A of the invention was compared to the technique described in the Canon™ TR-201 insert, the closest prior art technique.

Example 1

Using the Canon™ TR-201 technique, an 8½×11 inch size sheet of Kodak™ ink jet transfer paper was ironed onto a cotton tee-shirt by first ironing for approximately 10 seconds along a shorter edge. This was repeated six times as the iron was moved across the length of the paper. Then the transfer sheet was ironed for approximately 15 seconds along a longer edge, repeating four times as the iron was moved across the width of the paper. This was followed by ironing along the edges of the paper in a circular motion for 30 seconds. After the transfer sheet had been allowed to cool for approximately 2 minutes, the transfer sheet was pulled away from the tee-shirt.

The transfer technique of Method A according to the present invention was then used to transfer an image from an 8½×11 inch size sheet of Kodak™ ink jet transfer paper onto a cotton tee-shirt. The imaged transfer sheet was positioned with the front imaged surface of the transfer sheet in contact with the tee-shirt. The iron was held as shown in FIG. 1A, firmly pressed against the back non-imaged surface of the transfer sheet at a first starting position at the top right edge of the transfer sheet. The iron was then moved from right to left, as shown in FIG. 1A, making four passes of 20 seconds each while moving the first starting position of the iron towards the bottom right edge of the transfer sheet with each repetition. Each subsequent pass overlapped the path of the previous pass, and all edges of the transfer sheet were covered.

Figure 1B:
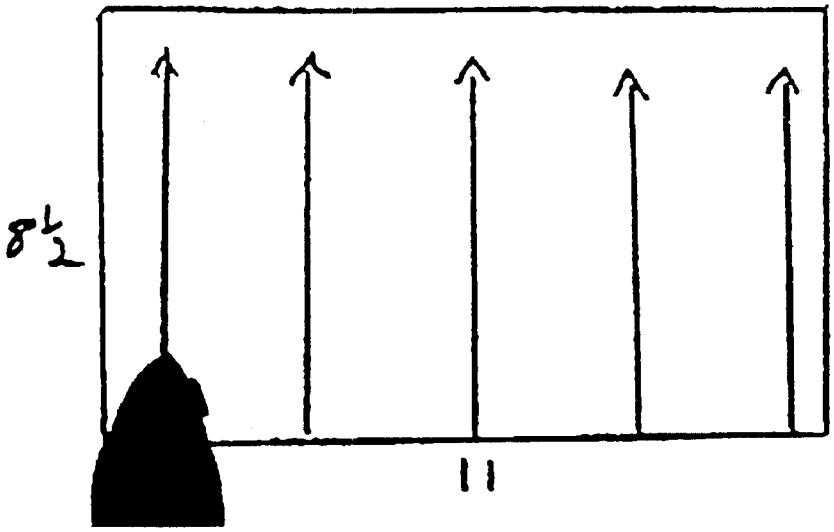
FIG. 1B corresponds to steps (e)–(g) of Method A, and to steps (b)–(d) of Method E. The iron is moving in a direction substantially parallel to the longitudinal axis of the iron.
Figure 2:
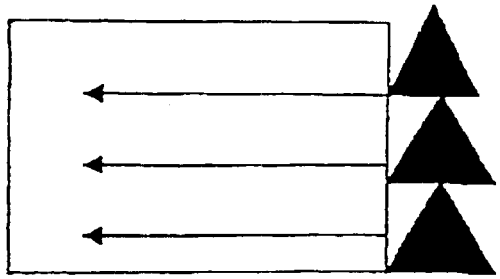
FIG. 2 is a diagram of the ironing method according to Methods B and F of the invention.
Figure 2:
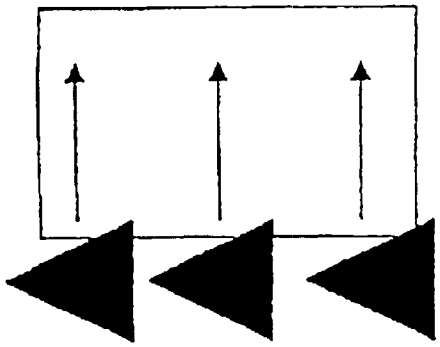
Figure 2:
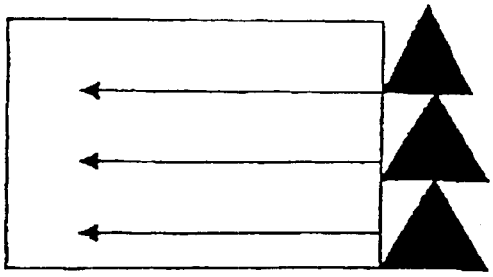
Figure 2:
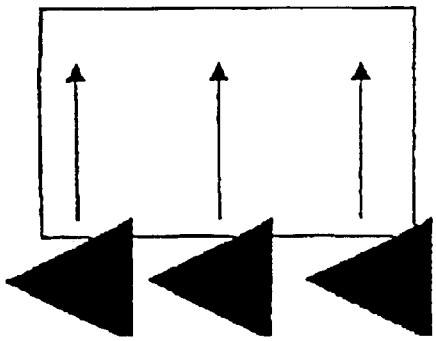
Figure 3A:
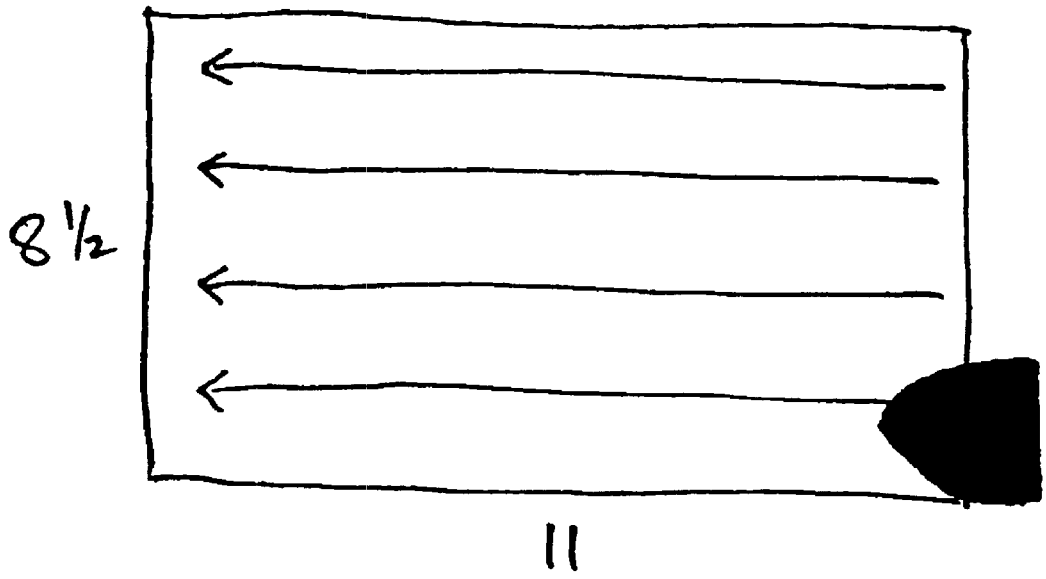
FIG. 3A corresponds to steps (b)–(d) of Method C, and to steps (e)–(g) of Method G.
Figure 3B:
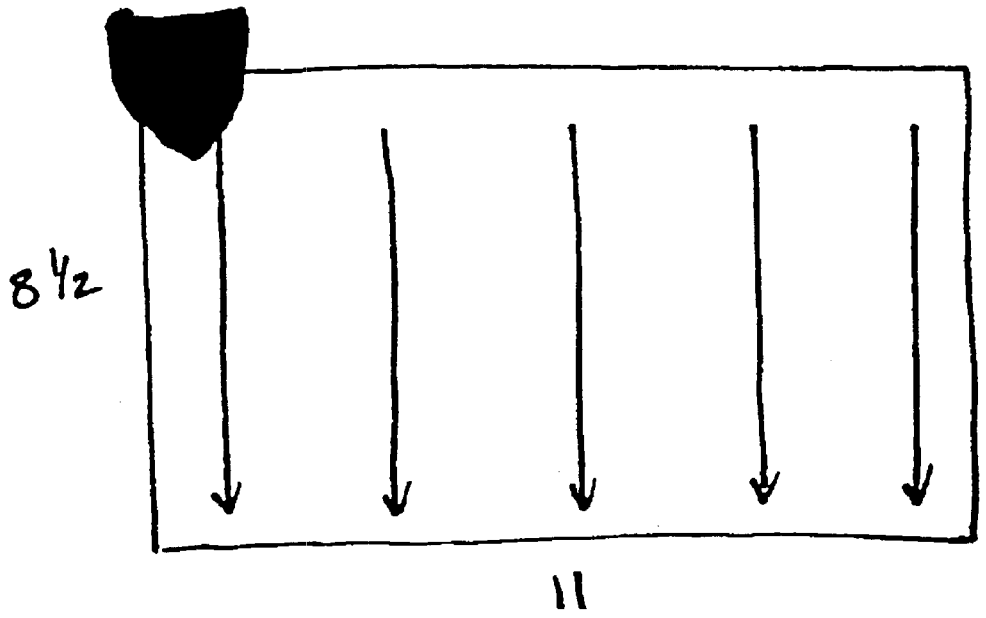
FIG. 3B corresponds to steps (e)–(g) of Method C, and to steps (b)–(d) of Method G. The iron is moving in a direction substantially parallel to the longitudinal axis of the iron.
Figure 4:
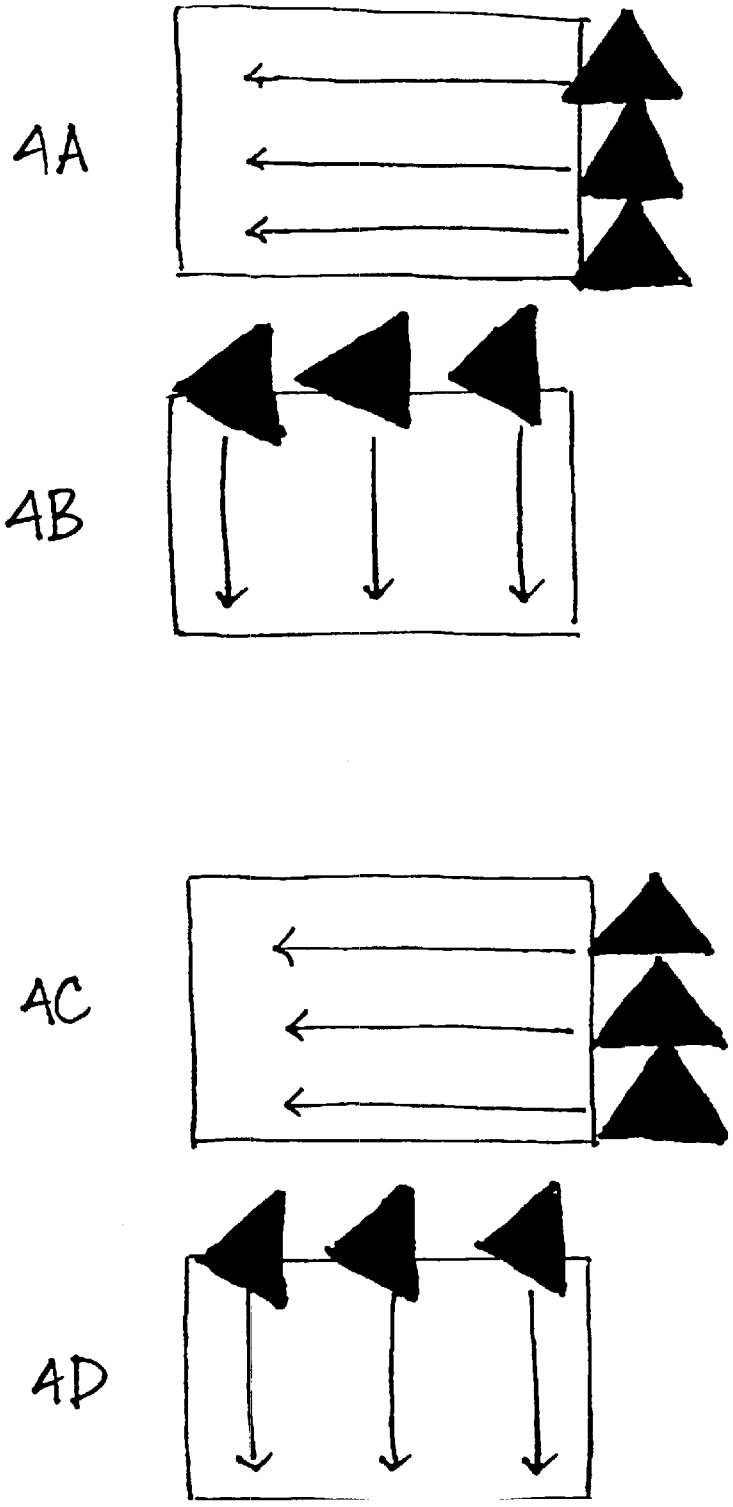
FIG. 4 is a diagram of the ironing method according to Methods D and H of the invention.

Then the iron was positioned as in FIG. 1B and was firmly pressed against the back non-imaged surface of the transfer sheet at a second starting position at the bottom left edge of the transfer sheet. The iron was moved from bottom to top, as shown in FIG. 1B, making five passes of 20 seconds each, while moving the second starting position of the iron towards the bottom right edge of the transfer sheet with each repetition. Each subsequent pass overlapped the path of the previous pass, and all edges of the transfer sheet were covered. The total ironing time was 3 minutes. The temperature of the iron was at its maximum setting (approximately 375° F.) in all of the tests. The transfer sheet was then allowed to cool completely before pulling the transfer sheet away from the tee-shirt.

The results were reviewed by a panel of three observers. Using the technique of the invention, the initial appearance of the image on the tee-shirt after ironing was clearer than when using the Canon™ TR-201 technique. The imaged tee-shirts were then washed five times, and the image was observed by the panel for clarity and washability (cracking and adhesion to tee-shirt). The image transferred using the technique of the invention was still clear and well adhered to the tee-shirt with no apparent cracking of the image after five washes. By comparison, the image transferred using the Canon™ TR-201 technique was less clear, and the image had begun to crack and flake off of the teeshirt after five washes.

The results are tabulated as follows:

TABLE t1

| Property | Invention | TR-201 |
|---|---|---|
| Clarity of image after washing | + | − |
| Cracking after washing | + | * |
| Adhesion after washing | + | − |

Clarity of image after washing: +clear, well defined image; −poorly defined image Cracking after washing: +little or no cracking of the image; *severe cracking of image Adhesion after washing: +image well adhered to receptor; −poor adhesion, loss of image from receptor This demonstrates an unexpected and improved transfer performance when using the ironing technique of the invention.

Example 2

The same procedure was followed as for Example 1, with the exception that the transfer paper used was that provided in the Canon™ TR-201 transfer package. The results are tabulated as follows:

TABLE t2

| Property | Invention | TR-201 |
|---|---|---|
| Clarity of image after washing | + | − |
| Cracking after washing | − | * |
| Adhesion after washing | − | * |

Clarity of image after washing: +clear, well defined image; −poorly defined image Cracking after washing: +little or no cracking of the image; −some cracking of the image; *severe cracking of image Adhesion after washing: +image well adhered to receptor; −poor adhesion, loss of image from receptor; *significant loss of image from receptor This demonstrates an unexpected and improved transfer performance when using the ironing technique of the invention.

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

Deposit of Computer Program Listings

Not Applicable

I claim:

1. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, across the top edge of the transfer sheet, towards the opposite top side edge of the transfer sheet, completing the pass in about 15 sec.–2 min.; (d) repeating the pass of step (c) at least three additional times while moving the first starting position of the iron towards the bottom side edge of the transfer sheet with each repetition, wherein each subsequent pass overlaps the path of the previous pass; (e) applying the iron to the back non-imaged surface of the transfer sheet at a second starting position at a bottom side edge of the transfer sheet;

(f) moving the iron in one pass in a path from said bottom side edge of the transfer sheet, and up along the side edge of the transfer sheet, towards the top side edge of the transfer sheet, completing the pass in about 15 sec.–2 min.; and (g) repeating the pass of step (f) at least four additional times while moving the second starting position of the iron towards the opposite bottom side edge of the transfer sheet with each repetition, wherein each subsequent pass overlaps the path of the previous pass.

2. The method according to claim 1, wherein the overlap in steps (d) and (g) is at least one inch.

3. The method according to claim 1, wherein the total ironing time is about three minutes.

4. The method according to claim 1 wherein the pass in steps (c) and (f) is completed in about 20–25 seconds.

5. The method according to claim 1, further comprising a final step wherein the transfer sheet is cooled completely before peeling the transfer sheet away from the imaged receptor element.

6. The method according to claim 1, further comprising a final step wherein the transfer sheet is cooled for one minute before peeling the transfer sheet away from the imaged receptor element.

7. The method according to claim 1, wherein the iron is moved in a direction substantially parallel to a longitudinal axis of the iron.

8. The method according to claim 1, wherein the top edge and bottom edge of the transfer sheet are each 11 inches in length, and wherein the two side edges of the transfer sheet are each 8½ inches in length.

9. The method according to claim 8, wherein the passes in step (c) and step (f) are each completed in about 20 seconds.

10. The method according to claim 1, wherein the top edge and bottom edge of the transfer sheet are each 210 mm in length, and wherein the two side edges of the transfer sheet are each 297 mm in length.

11. The method according to claim 10, wherein the passes in step (c) and step (f) are each completed in about 25 seconds.

12. The method according to claim 1, wherein the imaged transfer sheet comprises a support sheet, a transfer coating and an image thereon, said support sheet having a front and back surface, said transfer coating and said image positioned on said front surface of said support sheet, wherein said transfer coating melts and adheres to said receptor element having valleys or pores on the surface thereof as a result of ironing on the rear surface of said imaged transfer sheet, said image and non-image areas are carried with the transfer coating to the receptor element and the transfer coating resolidifies within the receptor element embedding the image and non-image areas therein, said transfer coating and image are in contact with the receptor element.

13. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, across the bottom edge of the transfer sheet, towards the opposite bottom side edge of the transfer sheet, completing the pass in about 15 sec.–2 min.; (d) repeating the pass of step (c) at least two additional times while moving the first starting position of the iron towards the top side edge of the transfer sheet with each repetition, wherein each subsequent pass overlaps the path of the previous pass; (e) applying the iron to the back non-imaged surface of the transfer sheet at a second starting position at a bottom side edge of the transfer sheet; (f) moving the iron in one pass from said bottom side edge of the transfer sheet, up along the side edge of the transfer sheet, towards the top side edge of the transfer sheet, completing the pass in about 15 sec.–2 min.; (g) repeating the pass of step (f) at least two additional times while moving the second starting position of the iron towards the opposite bottom side edge of the transfer sheet with each repetition, wherein each subsequent pass overlaps the path of the previous pass; (h) repeating steps (b) through (d); and (i) repeating steps (e) through (g).

14. The method according to claim 13, wherein the imaged transfer sheet comprises a support sheet, a transfer coating and an image thereon, said support sheet having a front and back surface, skid transfer coating and said image positioned on said front surface of said support sheet, wherein said transfer coating melts and adheres to said receptor element having valleys or pores on the surface thereof as a result of ironing on the rear surface of said imaged transfer sheet, said image and non-image areas are carried with the transfer coating to the receptor element and the transfer coating resolidifies within the receptor element embedding the image and non-image areas therein, said transfer coating and image are in contact with the receptor element.

15. The,method according to claim 13, wherein the overlap in steps (d) and (g) is at least one inch.

16. The method according to claim 3, wherein the total ironing time is about three minutes.

17. The method according to claim 13, further comprising a final step wherein the transfer sheet is cooled completely before peeling the transfer sheet away from the imaged receptor element.

18. The method according to claim 13, further comprising a final step wherein the transfer sheet is cooled for one minute before peeling the transfer sheet away from the imaged receptor element.

19. The method according to claim 13, wherein the iron is moved in a direction substantially perpendicular to a longitudinal axis of the iron.

20. The method according to claim 13, wherein the top edge and bottom edge of the transfer sheet are each 11 inches in length, and wherein the two side edges of the transfer sheet are each 8½ inches in length.

21. The method according to claim 20, wherein the passes in step (c) and step (f) are each completed in about 20 seconds.

22. The method according to claim 13, wherein the top edge and bottom edge of the transfer sheet are each 210 mm in length, and wherein the two side edges of the transfer sheet are each 297 mm in length.

23. The method according to claim 22, wherein the passes in step (c) and step (f) are each completed in about 25 seconds.

24. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, across the bottom edge of the transfer sheet, towards the opposite bottom side edge of the transfer sheet, completing the pass in about 15 sec.–2 min.; (d) repeating the pass of step (c) at least three additional times while moving the first starting position of the iron towards the top side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass in a path from said top side edge of the transfer sheet, and down along the side edge of the transfer sheet, towards the bottom side edge of the transfer sheet, completing the pass in about 15 sec.–2 min.; and (g) repeating the pass of step (f) at least four additional times while moving the second starting position of the iron towards the opposite top side edge of the transfer sheet with each repetition, wherein each subsequent pass overlaps the path of the previous pass.

25. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, across the top edge of the transfer sheet, towards the opposite top side edge of the transfer sheet, completing the pass in about 15 sec.–2 min.; (d) repeating the pass of step (c) at least two additional times while moving the first starting position of the iron towards the bottom side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass from said top side edge of the transfer sheet, down along the side edge of the transfer sheet, towards the bottom side edge of the transfer sheet, completing the pass in about 15 sec.–2 min.; (g) repeating the pass of step (f) at least two additional times while moving the second starting position of the iron towards the opposite top side edge of the transfer sheet with each repetition, wherein each subsequent pass overlaps the path of the previous pass; (h) repeating steps (b) through (d); and (i) repeating steps (e) through (g).

26. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, and up along the side edge of the transfer sheet, towards the top side edge of the transfer sheet, completing the pass in 20 sec.–about 2 min.; (d) repeating the pass of step (c) at least four additional times while moving the first starting position of the iron towards the opposite bottom side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass in a path from said top side edge of the transfer sheet, across the top edge of the transfer sheet, towards the opposite top side edge of the transfer sheet, completing the pass in about 15 sec.–2 min.; and (g) repeating the pass of step (f) at least three additional times while moving the second starting position of the iron towards the bottom side edge of the transfer sheet with each repetition, wherein each subsequent pass overlaps the path of the previous pass.

27. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a bottom side edge of the transfer sheet; (c) moving the iron in one pass in a path from said bottom side edge of the transfer sheet, up along the side edge of the transfer sheet, towards the top side edge of the transfer sheet, completing the pass in about 15 sec.–2 min.; (d) repeating the pass of step (c) at least two additional times while moving the first starting position of the iron towards the opposite bottom side edge of the transfer sheet with each repetition, wherein each subsequent pass overlaps the path of the previous pass; (e) applying the iron to the back non-imaged surface of the transfer sheet at a second starting position at a bottom side edge of the transfer sheet; (f) moving the iron in one pass from said bottom side edge of the transfer sheet, across the bottom edge of the transfer sheet, towards the opposite bottom side edge of the transfer sheet, completing the pass in about 15 sec.–2 min.; (g) repeating the pass of step (i) at least two additional times while moving the second starting position of the iron towards the top side edge of the transfer sheet with each repetition, wherein each subsequent pass overlaps the path of the previous pass; (h) repeating steps (b) through (d); and (i) repeating steps (e) through (g).

28. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, and down along the side edge of the transfer sheet, towards the bottom side edge of the transfer sheet, completing the pass in about 15 sec.–2 min.; (d) repeating the pass of step (c) at least four additional times while moving the first starting position of the iron towards the opposite top side edge of the transfer sheet with each repetition, wherein each subsequent pass overlaps the path of the previous pass; (e) applying the iron to the back non-imaged surface of the transfer sheet at a second starting position at a bottom side edge of the transfer sheet; (f) moving the iron in one pass in a path from said bottom side edge of the transfer sheet, across the bottom edge of the transfer sheet, towards the opposite bottom side edge of the transfer sheet, completing the pass in about 15 sec.–2 min.; and (g) repeating the pass of step (f) at least three additional times while moving the second starting position of the iron towards the top side edge of the transfer sheet with each repetition, wherein each subsequent pass overlaps the path of the previous pass.

29. A method of transferring an image from an imaged transfer sheet, having a front imaged surface and a back non-imaged surface, a top edge, a bottom edge and two side edges, onto a receptor element to produce an imaged receptor element, wherein the method comprises: (a) positioning an imaged transfer sheet with the front imaged surface of the transfer sheet in contact with the receptor element; (b) applying a heated iron to the back non-imaged surface of the transfer sheet at a first starting position at a top side edge of the transfer sheet; (c) moving the iron in one pass in a path from said top side edge of the transfer sheet, down along the side edge of the transfer sheet, towards the bottom side edge of the transfer sheet, completing the pass in about 15 sec.–2 min.; (d) repeating the pass of step (c) at least two additional times while moving the first starting position of the iron towards the opposite top side edge of the transfer sheet with each repetition, wherein each subsequent pass overlaps the path of the previous pass; (e) applying the iron to the back non-imaged surface of the transfer sheet at a second starting position at a top side edge of the transfer sheet; (f) moving the iron in one pass from said top side edge of the transfer sheet, across the top edge of the transfer sheet, towards the opposite top side edge of the transfer sheet, completing the pass in about 15 sec.–2 min.; (g) repeating the pass of step (f) at least two additional times while moving the second starting position of the iron towards the bottom side edge of the transfer sheet with each repetition, wherein each subsequent pass overlaps the path of the previous pass; (h) repeating steps (b) through (d); and (i) repeating steps (e) through (g).

* * * * *